US007228570B2

(12) United States Patent
Willis

(10) Patent No.: US 7,228,570 B2
(45) Date of Patent: Jun. 12, 2007

(54) BIB WITH WIPING EXTENSIONS

(76) Inventor: Laurie D. Willis, 2602 N. Revere Rd., Akron, OH (US) 44333

( * ) Notice: Subject to any disclaimer, the term of this patent is extended or adjusted under 35 U.S.C. 154(b) by 457 days.

(21) Appl. No.: 10/835,162

(22) Filed: Apr. 29, 2004

(65) Prior Publication Data

US 2005/0241043 A1 Nov. 3, 2005

(51) Int. Cl.
*A41B 13/10* (2006.01)

(52) U.S. Cl. ..... 2/49.1; 2/49.4

(58) Field of Classification Search ..... 2/49.1, 2/49.2, 49.5, 51, 52, 49.3, 49.4, 48, 46, 50, 2/75, 80, 104, 115, 111, 106, 105, 463; 446/26, 446/28; 40/586; D2/860–864, 776, 777, D2/745, 746

See application file for complete search history.

(56) References Cited

U.S. PATENT DOCUMENTS

| | | | | | |
|---|---|---|---|---|---|
| D62,270 | S | * | 5/1923 | Benson | D2/862 |
| D145,061 | S | | 6/1946 | Cameron | |
| D145,064 | S | | 6/1946 | Cameron | |
| D162,994 | S | | 4/1951 | Savron | |
| 2,705,803 | A | * | 4/1955 | Sheldrick et al. | 40/586 |
| 3,382,504 | A | * | 5/1968 | Barbosa | 2/80 |
| 4,466,136 | A | * | 8/1984 | Bottom et al. | 2/115 |
| 4,498,199 | A | * | 2/1985 | Margolis | 2/69 |
| D284,709 | S | | 7/1986 | Marconi | |
| 4,710,979 | A | | 12/1987 | Bull et al. | |
| 4,829,601 | A | | 5/1989 | Spanier | |
| 4,891,846 | A | | 1/1990 | Sager et al. | |
| 5,046,980 | A | | 9/1991 | Tai et al. | |
| 5,201,073 | A | | 4/1993 | Spanier | |
| 5,209,691 | A | * | 5/1993 | Ekstein | 446/28 |
| 5,477,560 | A | * | 12/1995 | Shope | 2/49.1 |
| D366,134 | S | | 1/1996 | Kolligian | |
| 5,490,289 | A | | 2/1996 | Lehrer | |
| D396,544 | S | | 8/1998 | Cameron | |
| 5,820,084 | A | | 10/1998 | Trumbauer et al. | |
| 5,898,940 | A | * | 5/1999 | Cameron | 2/49.1 |
| 5,960,471 | A | | 10/1999 | Burton | |
| 6,732,375 | B2 | * | 5/2004 | Nornes | 2/49.1 |

* cited by examiner

*Primary Examiner*—A. Vanatta
(74) *Attorney, Agent, or Firm*—Tarolli, Sundheim, Covell & Tummino LLP

(57) ABSTRACT

A bib suitable to be worn by a child during feeding. The bib includes a main body covering at least a portion of the child's chest and stomach. A front side of the main body faces away from the child and includes a representation of a decorative character. One or more components of the decorative character are affixed to the front side of the main body. The bib further includes an extension extending outwardly from a peripheral edge of the main body. The extension is a component of the decorative character. The extension includes a front side facing away from the child and a back side facing toward the child. The front side is fabricated of a soft, absorbent material suitable for wiping the child's face and the back side is fabricated of a stiffer material providing rigidity to the extension such that the extension has sufficient resiliency to return to an outwardly extending position with respect to the bib main body after the extension is used to wipe the child's face.

22 Claims, 1 Drawing Sheet

BIB WITH WIPING EXTENSIONS

FIELD OF THE INVENTION

The present invention relates to a bib and, more particularly, a bib including a decorative character affixed to a front of the bib and including extensions representing a portion of the decorative character for wiping a user's mouth and face.

BACKGROUND ART

Baby bibs are widely employed while feeding a baby to protect the baby and/or the baby's cloths from food and drink that is invariably spilled during the feeding process. Larger toddler bibs are also widely used to protect the clothing of older children who may be old enough to feed themselves or require limited help with feeding, but who are likely to spill food and/or drinks on themselves while eating. Adults similarly may use bibs to protect their clothing when eating foods that are particularly prone to dripping or slipping off eating utensils.

Various enhancements have been made to baby and toddler bibs to make them more attractive and/or more functional. For example, adding pockets to the bib for holding food, drinking containers, and/or wiping clothes improves the functionality of the bib. Adding sewn on or embroidered representations of animals, cartoon characters, and the like improve the decorative nature of the bib, provide stimulation or amusement to the baby or child during the feeding process and/or enhance acceptance of the bib by the baby or child during feeding.

For example, U.S. Pat. No. 4,829,601 to Spanier discloses a bib having decorative attachments. The '601 patent discloses a toddler bib that is configured to resemble a fanciful dog character and includes eyes, nose, mouth, tongue, arms, legs, tail, and floppy ears of the dog character sewn on to the bib main body.

Often times, when a baby is fed or when a toddler is feeding himself or herself, food and/or liquid is inadvertently spilled or smeared near the mouth, on the chin or cheeks of the child. What is needed is a bib having one or more extensions that may be used to quickly wipe and clean spilled food or drink from the face of the child. What would also be desirable is if the extension was an integral part of a decorative character, for example, the arms, legs, ears or tail of the decorative character.

However, a soft, absorbent material that is suitable for wiping a child's face generally does not have sufficient rigidity or stiffness to maintain its shape and position as part of a decorative character after use for wiping. What would also be desirable is an extension that included a soft, absorbent front or wiping surface for wiping the face of the child and a stiffer, cloth backing material for increased rigidity of the extension so that the extension maintains its shape and resumes its position as a portion of the decorative character after use of the extension for wiping. What is also needed is a bib main body including a smooth cloth front piece providing rigidity of the bib and a soft cloth backing piece adjacent the child's body or clothing for comfort and/or holding the bib in place on the child's chest and stomach.

SUMMARY OF THE INVENTION

One exemplary embodiment of the present invention is directed to a bib having a representation of a decorative character affixed to a front side of a main body of the bib.

The bib further includes an extension representing a portion of the decorative character affixed to and extending outwardly from the main body. The extension is of sufficient length to be used for wiping the mouth and face of a user of the bib. The extension is comprised of front side and a back side, the front side is comprised of a soft, absorbent fabric material and the back side is comprised of a stiffer material for increasing the rigidity of the extension. Preferably, the main bib body is includes of the front side and a back side fabricated of a soft, absorbent material. The extension is sewn to an edge of the bib main body and includes a representation of an arm, leg, ear, tail, hat, branch, leaf, or petal of the decorative character.

These and other objects, advantages, and features of the exemplary embodiment of the invention are described in detail in conjunction with the accompanying drawings.

DETAILED DESCRIPTION

Figure 1:
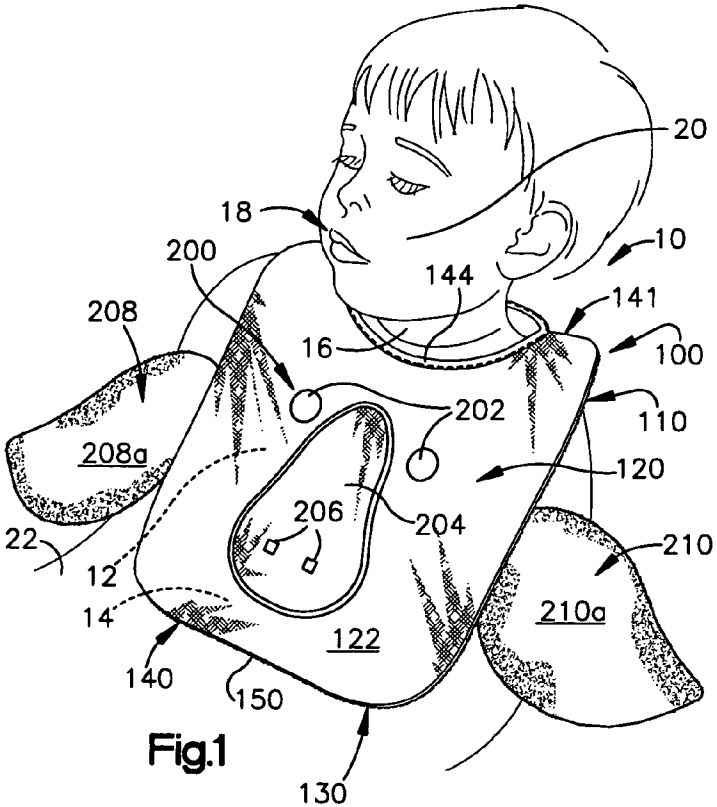
FIG. 1 is a front perspective view of a first embodiment of a bib of the present invention as worn by a child.

Turning to the drawings, an embodiment of a bib of the present invention is shown generally at 100 in FIG. 1, as worn by a child 10 during feeding to protect the child and/or the child's clothing during the feeding process. The bib 100 is tied around the child's neck 16 and generally covers at least a portion of the child's chest and stomach areas 12, 14.

It should be understood that the bib 100 of the present invention may be fabricated in various sizes to properly fit children of different sizes and ages from infants to toddlers to school aged children, as well as adults, and it is the intent of the present invention to cover all such sizes and users of the bib. Additionally, while the disclosed embodiment of the bib 100 discloses a decorative character in the form of a particular imaginary animal with extending ears, it should be understood that the decorative character can be any of a wide variety of characters including, without limitation, the following: dog, cat elephant, panda, frog, fish, duck, bird, hippopotamus, pig, owl, bat, deer, moose, turkey, giraffe, alligator, horse, donkey, butterfly, chicken, cow, bee, sheep, mouse, lobster, crab, goat, guinea pig, hamster, turtle, whale, dolphin, shark, happy face character, train, flower, sun, moon, stars, cloud, tree, airplane, car, truck, angel, Santa Claus, snowman, valentine heart, shamrock, monster, clock, boat, helicopter, fire truck, witch, and pumpkin. As used herein, decorative characters include both animate and inanimate objects as well as real and imaginary beings and objects.

The bib 100 includes a generally rectangular main body 110 sized to overlie at least a portion of the child's chest and stomach 12, 14 to protect the child or the child's clothing from food or drink spilled, dropped or smeared during the process of eating. The main body 110 is comprised of two pieces of material 120, 130 attached along an outer periphery 140. Preferably, as will be explained below, a third piece of interfacing or stabilizer material 128 is disposed between the two pieces 120, 130 for additional rigidity and to minimize puckering when fabric pieces or appliques are attached to the first piece of material 120.

The pieces 120, 130 may alternatively be attached via adhesive or other means known to those of ordinary skill in the art. Also, the two pieces 120, 130 of material are preferably attached along the outer periphery 140. However, it should be recognized that the pieces 120, 130 alternately could be attached over some or all of their respective contact surfaces, i.e., adhesively attaching some or all of the contact surfaces of pieces 120, 130.

Figure 3:
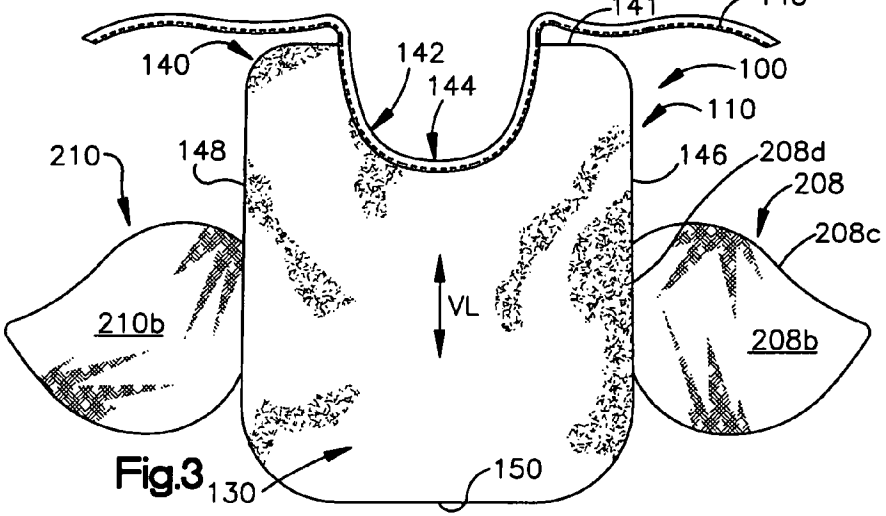
FIG. 3 is a back elevation view of the bib of FIG. 1.

The peripheral edge 140 includes an upper peripheral edge 141, spaced apart side peripheral edges 146, 148 and a bottom peripheral edge 150. The side peripheral edges 146, 148 extend along a vertical length VL (FIG. 3) of the bib 10. An arcuate shaped cut out 142 along the upper peripheral edge 141 of the main body 110 is contoured for accepting and fitting against a front portion of the child's neck 16. Stitched along the cut out 142 of the upper peripheral edge 141 of the main body 110 is a trim piece in the form of a tie closure 144 which has sufficient length extending beyond the bib 100 to be easily tied at a back of the child's neck 16 to secure the bib 100 to the child 10.

The two pieces of material 120, 130 comprising the main body 110 are preferably fabric material. The first piece of material 120 facing forwardly, that is, facing away from the child 10 is a tightly woven, washable material. One example of a suitable fabric for the first piece of material 120 would be denim material. Corduroy material would also be suitable. This first piece 120 provides stiffness and rigidity to the main body 110 so that it holds its shape during use and provides a suitable surface for attachment of the decorative character 200 to a front surface 122 of the first piece 120 as will be described below.

The second piece of material 130 of the main body 110 is a soft, absorbent washable material such as a cotton looped or sheared terry cloth material or a cotton towel type material. Chenille fabric is another example of a suitable material for the second piece of material 130. The second piece of material 130 provides a soft surface against the child's body. This is especially important in the event the child is not wearing a shirt when wearing the bib 100. The second piece of material 130 also provides protection from abrasion to the child's chest 12 and stomach 16 from stitching, i.e., the stitching through the first piece of material 120 which attaches components of the decorative character 200 to a front surface 122 of the first piece 120. Even if the child 10 is wearing a shirt, the second piece of material 130, having a non-smooth, towel-type surface, tends to stick to other fabric materials, such as the child's shirt,. Thus, the bib 100 will tend to remain in place on the child's shirt during use, as compared to a smooth surface fabric or plastic material that would tend to slide off the child's shirt as the child moves during feeding.

Figure 4:
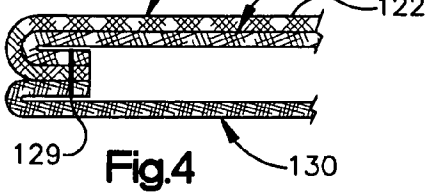
FIG. 4 is a schematic sectional view of a main body of the bib of FIG. 1 showing an interfacing piece of material disposed between a first and a second piece of material.

To provide additional stiffness and rigidity to the main body 110 and to reduce puckering of the first piece of material 120 when appliques representing components of the decorative character 200 are sewn to the front surface 122 of the first piece 120, the third piece of material 128 is positioned between the first and second pieces of material 120, 130. The three pieces of material are sewn together. The third piece of material 128 may be, for example, interfacing or stabilizer material or any other thin piece of material. Preferably, as can best be seen in FIG. 4, during assembly, the third piece of material 128 is positioned between the first and second pieces 120, 130 and the three pieces are stitched together, as can be seen at 129. Advantageously, using the interfacing piece 128 as a backing for the first piece 120 tends to reduce puckering of the first piece 120 when appliques of the decorative character 200 are sewn to the first piece 120.

Alternately, it should be recognized that instead of using two pieces of material or two pieces of material, the main bib 110 could alternately be comprised of a single piece of material having a smooth surface facing forwardly and towel-type soft, absorbent surface facing the child.

Attached to the front surface or side 122 of the first piece 120 is a representation of a decorative character 200. Essentially, in this exemplary embodiment, the decorative character 200 is a head of a stylized, imaginary animal, specifically a duck. The decorative character 200 includes the bib main body 110 which represents the head of the character, a pair of sewn-on circular colored fabric pieces or appliques 202 representing a pair of spaced apart eyes of the duck, and a sewn-on colored fabric piece or applique 204 representing a pear-shaped nose of the decorative character 200.

The eyes and nose appliques 202, 204 fabric pieces are attached to the main body front surface 122, preferably by sewing using a satin stitch. Advantageously, the stitching extends through the first piece 120 and the interfacing or stabilizer piece 128 to minimize puckering of the first piece 120 when the appliques 202, 204 are sewn on to the front surface 122. It should be recognized, however, that other means of attachment of the appliques 202, 204 to the first piece front surface 122 are possible including adhesive and hood and eye material attachment. Strips of stitching 206, representing a pair of contrasting color nostrils 206 are sewn on the pear-shaped nose fabric piece 204, preferably using a satin stitch.

If the rigidity of the bib main body 110 is sufficient without the addition of a interfacing piece 128, an option would be to use a tear-away interfacing piece that is utilized as backing material to minimize puckering when sewing the appliques to the front side 122 of the first piece 120. Upon completion of sewing the appliques to the first piece and the interfacing material 128, the tear-away interfacing material 128 is then torn away from the first piece 120. After tearing away the interfacing piece 128, the only remaining portions of the interfacing piece in the bib main body 110 are in the areas where the appliques are stitched to the first piece 120 and the interfacing material 128.

The decorative character 200 further includes a pair of extensions 208, 210 representing a pair of ears of the character 200. The extensions 208, 210 extend outwardly from opposite sides 146, 148 of the periphery 140 of the main body 110. The extensions 208, 210 each are comprised of two pieces of material 208*a*, 208*b* and 210*a*, 210*b* respectively. The two extensions 208, 210 may have the same shape and size or differ in shape and/or size depending on the decorative character 200 being depicted. For example, in the illustrated embodiment, the extensions 208, 210 depict or represent the wings of the imaginary duck, thus, it would be expected that the extensions 208, 210 (ears) would be the same size and shape. If, on the other hand, the decorative character were a fanciful tree, extensions representing the tree branches and/or leaves may be of differing size and shape.

Further, the number of extensions may be one, two, three or more depending on the decorative character being depicted and the feature or features of the character being represented by the extensions (ears, arms, legs, hair, hat, cane, branches, petals, etc.). Additionally, again, depending on the decorative character being depicted and the feature or features of the character being represented by the one or more extensions, the extensions of the bib may extending outwardly from the main body at various angles or directions from either the upper peripheral edge 141, the sides 146, 148 or the bottom peripheral edge 150 of the main body 110.

Figure 2:
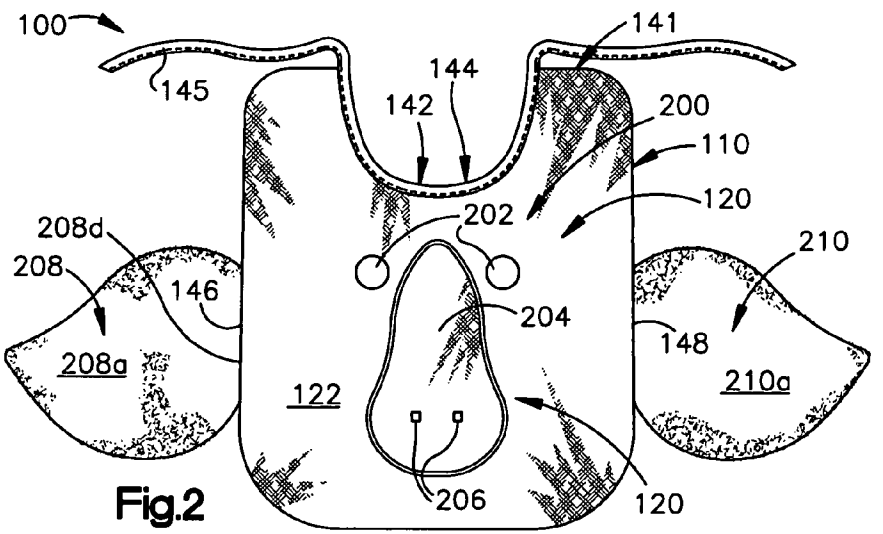
FIG. 2 is a front elevation view of the bib of FIG. 1.

The extension 208 will be described below. It is to be understood that the extension 210 is similar in construction. The first piece of material 208*a* (FIG. 2) of the extension 208, which faces forwardly away from the child 10, is a soft, absorbent cotton looped or sheared terry cloth or towel type material which is suitable for wiping the child's mouth and chin area 18, cheeks 20 and/or hands (not shown) during feeding in the event that food or drink is accidentally smeared, dribbled or spilled on the mouth, chin, cheeks, or hands. The second piece of material 208*b* (FIG. 3) of the extension 208 is attached to the first piece 208*a* and faces toward the child 10. The second piece of material 208*b* is a tightly woven fabric material which provides rigidity and stiffness. Advantageously, after the extension 208 is folded over, such that the absorbent first piece of material 208*a* is facing toward the child 10 and is used to wipe the child's mouth, chin, etc., the extension 208 has sufficient resiliency and memory to return to an outwardly extending position with respect to the bib main body 110 instead of simply dangling limply along the side 146 of the main body 110.

Preferably, the extension 208 is of sufficient length in a direction extending outwardly from the main body 110 to reach the child's mouth by pulling slightly upwardly on the bib 100 and is sized to provide a sufficient wiping area for repeated wiping of the child 10 during the feeding process.

Typically, the first and second pieces of material 208*a*, 208*b* are identical in size and are attached by sewing along an outer periphery 208*c* of the pieces. However, the pieces 208*a*, 208*b* may be attached via adhesive or other means known to those of ordinary skill in the art either along their periphery 208*c* or over some or all of their respective contact surfaces, i.e., adhesively attaching the entire contact surfaces of the pieces. Additionally, the pieces 208*a*, 208*b* may be of differing size or shape if desired depending on the stiffness of the second piece 208*b*.

It should also be recognized that the extensions 208, 210 could additionally include an interfacing or stabilizer piece between the pieces 208*a*, 208*b* if it is desired to have additional stiffness and/or resiliency of the extensions 208, 210, as was the case with the bib main body 110. Alternately, it should also be recognized that instead of using two pieces of fabric, the extensions 208, 210 could alternately be comprised of a single piece of material having a soft, absorbent surface facing forwardly and a smooth surface facing the child provided the extensions 208, 210 had sufficient rigidity and stiffness to return to an outwardly extending position with respect to the bib main body 110 after use for wiping.

Fabrication of Bib 100

In one exemplary embodiment, the fabrication of the bib 100 may be performed as set forth below. In fabricating the extension 208, the two pieces 208*a*, 208*b* are aligned and sewn along the outer periphery 208*c*, except for a portion of the periphery 208*d* that is attached to the bib main body 110, which is left open. After sewing, the extension 208 is turned inside out by pulling the extension through the open periphery portion 208*d* (similar to pulling a sock inside out) thereby hiding the peripheral stitching between the first and second pieces 208*a*, 208*b*. The same method is used in fabricating the extension 210.

A similar method is advantageously used to hide the peripheral stitching attaching the first and second pieces 120, 130 and the interfacing piece 128 of the main body 110 together. The extensions 208, 210 are positioned, facing inwardly toward each other, between the first and second pieces 120, 130. The first and second pieces 120, 130 are aligned. The side 122 of the first piece 120 having the eyes 202 and nose 204 sewn to it is positioned to face inwardly toward the extensions 208, 210. Specifically, the side 122 of the first piece 120 is positioned to face the terry cloth sides 208*a*, 210*a* of the extensions 208, 210.

The extensions 208, 210 are first sewn to the first piece 120. Then, the first, second and interfacing pieces 120, 130, 128 are aligned and then sewn together along the bottom and side peripheral edges 150, 146, 148 and the upper peripheral edge 140, except for the neck cut out portion 142, which is not sewn. This second sewing affixes the extensions 208, 210 (which are facing inwardly) to the bib main body 110 with a double stitching. The main body 110 is then turned inside out by pulling the main body through the open neck cut out portion 142. Turning the main body 110 inside out after sewing results in: 1) the extensions 208, 210 properly facing outwardly (that is facing outwardly away from each other and the main body 110) with the terry cloth pieces 208*a*, 210*a* facing forwardly; 2) the side 122 of the first piece 120 having the eyes 202 and the nose 204 facing forwardly; and 3) the stitching between the main body pieces 120, 130 being hidden.

The first, second and interfacing pieces 120, 130, 128 in the neck cut out portion 142 are then sewn together thereby closing the opening defined by the cut out portion 142. Finally, the tie closure 144 is placed on and folded over the neck cut out portion 142 and sew along the dashed line 145 (FIG. 2) thereby affixing the closure 144 to the first and second pieces 120, 130 of the main body 110.

While the present invention has been described with a degree of particularity, it is the intent that the invention include all modifications and alterations from the disclosed design falling with the spirit or scope of the appended claims.

I claim:

1. A bib suitable to be removably worn during feeding, the bib comprising:

a) a main body covering at least a portion of a chest of a wearer of the bib, a front side of the main body facing away from the wearer including a representation of a decorative character, one or more components of the decorative character affixed to the front side of the main body; and b) an extension extending outwardly from a peripheral edge of the main body, the extension being a component of the decorative character, the extension including a front side facing away from the wearer and a back side facing toward the wearer, the front side comprising a soft, absorbent material suitable for wiping the wearer's face and the back side comprising a stiffer material providing rigidity to the extension.

2. The bib set forth in claim 1 wherein the extension has sufficient resiliency to return to an outwardly extending position with respect to the bib main body after the extension is used to wipe a face of the wearer.

3. The bib set forth in claim 1 wherein the extension is comprised of a first and a second piece of fabric affixed together, the first piece of fabric comprising the front side of the extension and the second piece of fabric comprising the back side of the extension.

4. The bib set forth in claim 3 wherein the first piece of fabric is terry cloth and the second piece of fabric is woven cotton.

5. The bib set forth in claim 3 wherein the first and second pieces of fabric are attached by sewing.

6. The bib set forth in claim 1 wherein the decorative character is an animal and the extension represents a part of the animal.

7. The bib set forth in claim 1 wherein the main body is comprised of the front side facing away from the wearer and a back side facing the wearer and the front side is comprised of a smooth material and the back side is comprised of a soft, absorbent material.

8. The bib set forth in claim 7 wherein the main body is comprised of a first piece of material, a second piece of material and an interfacing piece of material disposed between the first and second pieces of material and all three pieces being affixed together, the first piece of material comprising the front side of the main body and the second piece of material comprising the back side of the main body.

9. The bib set forth in claim 1 wherein the front side of the main body is comprised of a woven cloth material.

10. The bib set forth in claim 8 wherein the first, second and interfacing pieces of material are attached by sewing.

11. The bib set forth in claim 1 wherein the main body is generally rectangular and the periphery of the main body includes spaced apart opposite sides extending a length of the bib separated by top and bottom sections and the extension comprises first and second extensions extending from respective opposite sides of the periphery of the main body.

12. A bib suitable to be removably worn during feeding, the bib comprising:

a) a main body covering at least a portion of a chest of a wearer of the bib, a front side of the main body facing away from the wearer including a representation of a decorative character, one or more components of the decorative character affixed to the front side of the main body, the main body being comprised of the front the side facing away from the wearer and a back side facing the wearer and the front side is comprised of a smooth, woven material and the back side is comprised of a soft, absorbent material adjacent the wearer; and b) an extension extending outwardly from a peripheral edge of the main body, the extension being a component of the decorative character and including a first side comprising a soft, absorbent material being suitable for wiping a face of the wearer and a second side comprising a stiffer material providing rigidity to the extension.

13. The bib set forth in claim 12 wherein the first side of the extension faces away from the wearer and the second side faces toward the wearer.

14. The bib set forth in claim 13 wherein the extension is comprised of a first and a second piece of fabric affixed together, the first piece of fabric comprising the first side of the extension and the second piece of fabric comprising the second side of the extension.

15. The bib set forth in claim 14 wherein the first piece of fabric is terry cloth and the second piece of fabric is woven cotton.

16. The bib set forth in claim 14 wherein the first and second pieces of fabric are attached by sewing.

17. The bib set forth in claim 12 wherein the decorative character is an animal and the extension represents a part of the animal.

18. The bib set forth in claim 12 wherein the main body is comprised of a first piece of material and a second piece of material affixed together, the first piece of material comprising the front side of the main body and the second piece of material comprising the back side of the main body.

19. The bib set forth in claim 18 wherein the first piece of material is woven cotton and the second piece of material is terry cloth.

20. The bib set forth in claim 18 wherein the first and second pieces of material are attached by sewing.

21. The bib set forth in claim 12 wherein the main body is generally rectangular and the periphery of the main body includes spaced apart opposite sides extending a length of the bib separated by top and bottom sections and the extension comprises first and second extensions extending from respective opposite sides of the periphery of the main body.

22. The bib set forth in claim 21 wherein the top section of the main body periphery includes a tie closure affixed thereto suitable for tying the bib around a neck of the wearer.

* * * * *